United States Patent [19]

D'Ambrosio

[11] Patent Number: 4,970,728

[45] Date of Patent: Nov. 20, 1990

[54] GARMENT WAISTBAND CONSTRUCTION

[76] Inventor: Anthony D'Ambrosio, 10th St. and Godfrey Ave., Philadelphia, Pa. 19126

[21] Appl. No.: 521,569

[22] Filed: May 10, 1990

[51] Int. Cl.[5] ..... A41D 1/06; A41D 1/14; A41B 9/14

[52] U.S. Cl. ..... 2/237; 2/220; 2/221; 2/236; 2/76

[58] Field of Search ..... 2/237, 236, 221, 220, 2/76

[56] References Cited

U.S. PATENT DOCUMENTS

| | | | |
|---|---|---|---|
| 2,195,894 | 4/1940 | Moore . | |
| 2,277,227 | 3/1942 | Hardie . | |
| 2,708,274 | 5/1955 | Vander et al. . | |
| 2,757,381 | 8/1956 | Cottier et al. . | |
| 3,663,963 | 5/1972 | Miller | 2/237 |
| 3,723,993 | 4/1973 | Ruby . | |
| 3,813,698 | 6/1974 | Campbell, Jr. et al. | 2/237 |
| 3,848,268 | 11/1974 | D'Ambrosio . | |
| 3,868,729 | 3/1975 | Lynam | 2/237 |
| 3,869,728 | 3/1975 | Spencer | 2/237 |
| 4,332,034 | 6/1982 | Muse . | |
| 4,549,317 | 10/1985 | D'Ambrosio | 2/237 |

*Primary Examiner*—Werner H. Schroeder
*Assistant Examiner*—Gloria Hale
*Attorney, Agent, or Firm*—Woodcock Washburn Kurtz Mackiewicz & Norris

[57] ABSTRACT

An improved waistband construction for garments including a new one piece flat elastic strip having upper and lower portions of different stretchability. The elastic strip is connected to the fabric of the waistband and the shell of the garment so as to allow more expansion and comfort in fitting multiple sizes.

14 Claims, 2 Drawing Sheets

GARMENT WAISTBAND CONSTRUCTION

FIELD OF THE INVENTION

This invention relates to the manufacture of garments and more particularly to an improved waistband construction for garments whereby a single garment may be manufactured so as to properly fit persons varying over several standard waist sizes.

BACKGROUND OF THE INVENTION

The present invention is an improvement over the invention disclosed in my U.S. Pat. No. 4,549,317 which in turn was an improvement over the invention disclosed in my U.S. Pat. No. 3,848,268. My prior patents disclosed and claimed garments having improved waistband constructions by which a single garment usually fits persons having waist sizes in the range of three standard sizes. The waistband constructions of my prior patents both employed an elastic strip in the waistband construction with a fabric curtain depending therefrom. In my U.S. Pat. No. 3,848,268 the fabric curtain was secured to the inside surface of the elastic strip facing the wearer. In my U.S. Pat. No. 4,549,317 the fabric curtain was secured to the outside surface of the elastic strip facing away from the wearer.

The constructions shown in my previous patents have enjoyed substantial success but I have now discovered that I can eliminate the fabric curtain by using a new one piece flat elastic strip having upper and lower portions of different stretchability and in doing so provide an improved waistband construction by which a single garment will fit persons having waist sizes in the range of up to four standard sizes. While prior patents such as Moore U.S. Pat. No. 2,195,894, Ruby U.S. Pat. No. 3,723,993, and Muse U.S. Pat. No. 4,332,034 have disclosed the use of elastic bands of different stretchability, such waistband constructions have left something to be desired. My improved waistband construction not only allows more expansion and comfort in fitting multiple sizes but also results in savings in cost of the curtain cloth material and saving in the labor in binding and attaching the curtain to the elastic strip used in my prior patents. It also provides for easier finish pressing of the garment and is cosmetically cleaner both inside and outside.

OBJECTS OF THE INVENTION

It is an object of the invention to provide an improved waistband construction for garments which accommodate persons of varying waist sizes without causing unsightly bulges, folds, wrinkles, or the like. It is a further object of the invention to provide an improved waistband construction which eliminates the conventional fabric curtain thus providing a smoother inside and outside appearance of the waistband. By providing an improved elastic strip in the waistband assembly to make the sole contact with the wearer's waist there is provided an improved gripping on the waist without binding. The slipping is eliminated and a holding grip is maintained on the waist even when the wearer is moving. The improved waistband construction of the present invention provides a floating waistband action which automatically adjusts upwardly and downwardly to conform to the wearer waistline. Due to the simplified construction and cosmetic appearance of the improved waistband it can be used on all waistband garments for men, women and children including fine dress garments or work clothes.

SUMMARY OF THE INVENTION

In accordance with the present invention there is provided an improved waistband assembly for a garment comprising a waistband of a fabric material turned over at its upper extremity to form a U-shaped bight with a small inner flap depending therefrom. An elastic strip of one piece construction having an upper portion which is longitudinally elastic including means substantially preventing transverse bending of the upper portion thereby to exhibit no-roll characteristics. The upper portion is positioned adjacent to and sewn to the side of the inner flap facing inwardly to the wearer away from the waistband at the top of the strip. The elastic strip has a lower portion extending below the lower edge of the waistband, the lower portion of the elastic strip offering a lower resistance to elongation than the upper portion of the elastic strip. In accordance with one aspect of the invention the lower portion of the elastic strip has a stretchability of about 85% with a range of plus or minus 10% and the upper portion of the elastic strip has a stretchability of about 53% with a range of plus or minus 10%. The ratio of the width of the upper portion of the elastic strip to the lower portion of the elastic strip is about 3 to 1.

In accordance with another aspect of the invention there is provided a waistband construction for clothing comprising a shell portion and a waistband portion wherein the exposed fabric of the shell portion and waistband portion may be of any desired fabric material. The waistband portion of the fabric material is cut on a bias and the waistband portion being turned over at its upper extremity to form a U-shaped bight portion with a small inner flap depending therefrom. An elastic strip of one piece construction having an upper portion which is longitudinally elastic, including means substantially preventing transverse bending of the upper portion thereby to exhibit non-roll characteristics, is positioned adjacent to and sewn to the side of the inner flap facing inwardly to the wearer away from the waistband portion at the top of the strip. The elastic strip has a lower portion extending below the lower edge of the waistband portion, the lower portion of the elastic strip offering a lower resistance to elongation than the upper portion of the elastic strip to provide better gripping on the waist without binding. A shell portion of the fabric is joined to the lower edge of the waistband portion at a location above the lower edge of the elastic strip wherein the shell portion has formed therein several gathers, the gathers being concealed by the elastic strip away from the wearer so that the shell portion exhibits fullness, whereby a garment incorporating the waistband construction can accommodate persons of several waist sizes. The elastic strip is stitched at periodic intervals around the waistband portion to the juncture between the shell portion of the fabric and the lower edge of the waistband portion to prevent restriction of stretch. A fusible non-woven material is secured to the inner face of the waistband portion, the non-woven material having the characteristic of being stretchable in the longitudinal direction and substantially non-stretchable in the transverse direction.

For more detailed disclosure of the invention and for further objects and advantages thereof, reference is to be had to the following description taken in conjunction with the accompanying drawings.

DESCRIPTION OF THE PREFERRED EMBODIMENT

As pointed out above, the present invention is an improvement on my prior waistband constructions disclosed in my aforesaid U.S. Pat. Nos. 3,848,268 and 4,549,317. The disclosures in those patents are incorporated herein by this reference thereto. Accordingly, where a specific constructional detail is not specified herein, it may in general be assumed that the construction is similar to that previously shown.

Figure 1:
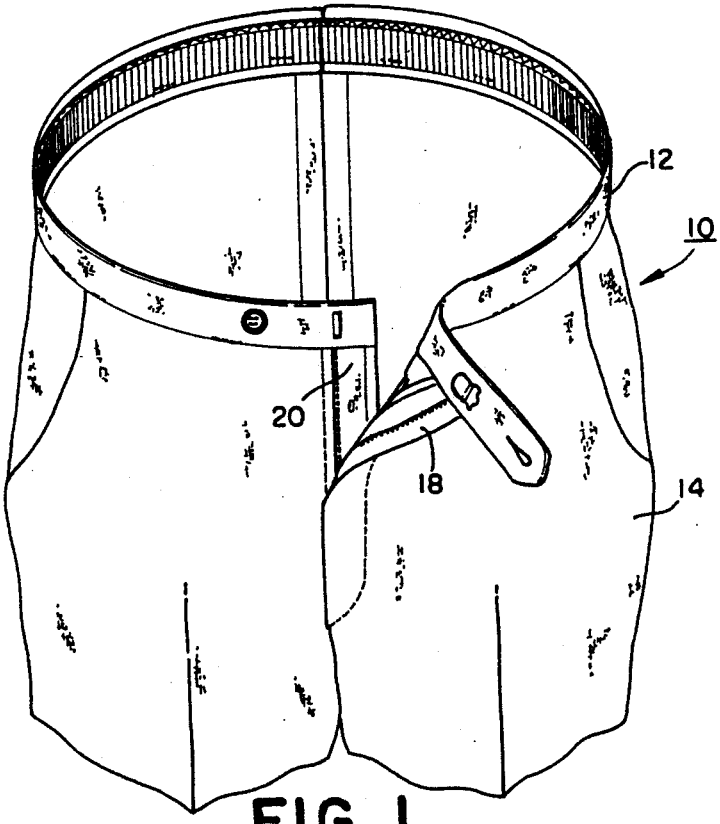
FIG. 1 is a perspective view of the waistband area of trousers embodying the improved waistband construction of the present invention.
Figure 2:
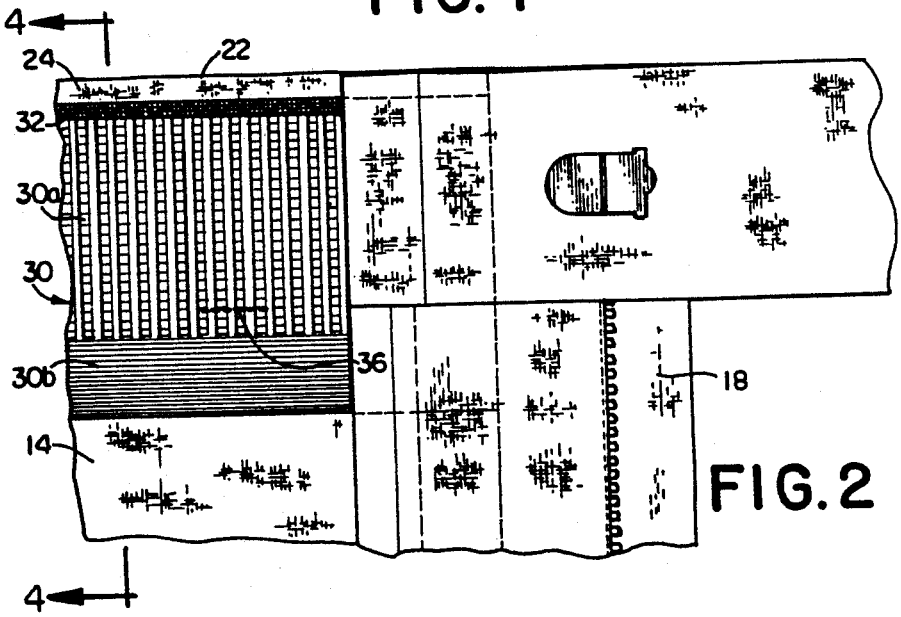
FIG. 2 is a fractional side elevational view of the so-called "black fly" portion of the trousers as seen from the inside.

Referring to FIG. 1 there is shown a pair of trousers or slacks 10 having a waistband 12 attached to the garment shell 14. The fabric of the waistband 12 and the lower shell 14 are of the same material. Any material is suitable and it is not limited to what is known in the trade as stretchable material. However, as hereinafter described the waistband 12 is cut on a bias so that it will be capable of stretching. At the front of the trousers the fly portion comprises a black fly portion 18, in FIG. 2, and a mating white fly portion 20, FIG. 3, including the conventional zipper components and metal clip and mating retainer. Pockets may also be provided as shown. It will also be understood that the waistband construction of the present invention is useful for garments other than trousers, such as ladies and children's skirts, and the fly need not necessarily be provided.

As pointed out above the waistband 12 stretches because it is cut on a bias, i.e., the warp and woof are inclined with respect to the horizontal, preferably between about 30° to 50°. The shell 14 is not required to be cut on a bias. As hereinafter described, by providing the shell 14 with a small degree of "fullness" the warp and woof can be vertically aligned, while permitting the waistband to accommodate persons of several sizes in comfort, without unsightly bulging, while allowing the waistband 12 and shell 14 to be made of any desired material including such non-stretchable fabrics as corduroy.

Figure 4:
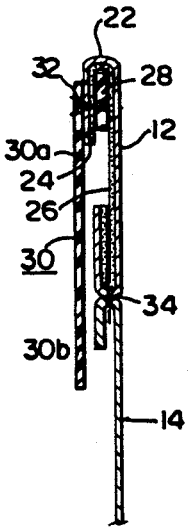
FIG. 4 is a cross-sectional view taken along the lines 4—4 in FIG. 2.
Figure 5:
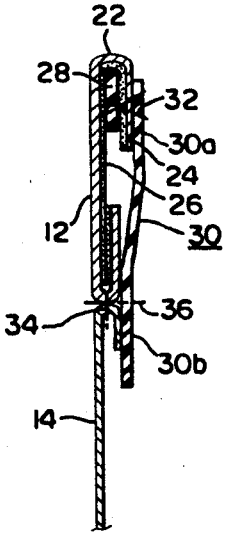
FIG. 5 is a cross-sectional view taken along the lines 5—5 in FIG. 3.

As best shown in FIGS. 4 and 5 the fabric material of the waistband 12 is turned over at its upper extremity to form a U-shaped bight 22 with a small inner flap 24 depending therefrom. The inner face of the waistband 12 has adhesively secured thereto a fusible non-woven material 26 having the characteristic of being stretchable in the longitudinal direction and substantially non-stretchable in the transverse direction. Disposed within the U-shaped bight 22 is a header or strip 28 of stiffening elastic material. The strip 28 preferably has a width of about ⅜" to ⅝" and a stretchability in the range of about 100% to 120%. The waistband construction includes an elastic strip 30 of one piece construction having an upper portion **30*a* which is a longitudinally elastic webbing of width wise rigidity ribbed weave and includes a series of reinforced vertical ribs for preventing transverse bending of the upper portion thereby to exhibit non-roll characteristics. The upper portion 30*a* is positioned adjacent to and sewn to the side of the inner flap 24 facing inwardly to the wearer away from the waistband at the top of the strip 30. As may be seen in FIGS. 4 and 5 the stitching 32 joins the upper portion of the elastic strip 30*a* with the elastic strip 28 and the depending flap 24 but does not extend through the outer or exposed face of the waistband 12. It will also be noted that the upper edge of the elastic strip 30 is well below the bight 22 so as to be concealed from view when the garment is worn and assuring an attractive appearance of the waistband. The elastic strip 30 also includes a lower portion 30*b* extending below the lower edge of the waistband 12. The lower portion 30*b* of the elastic strip 30 is also longitudinally elastic in the form of flat woven elastic webbing and has the characteristic of offering a lower resistance to elongation than the upper portion 30*a* of the elastic strip 30. The elastomer used in the elastic strip 30 may be of Spandex or Lycra and polyester or equivalent. In general, the lower portion of the elastic strip has a degree of stretchability with respect to the upper portion of the elastic strip within the range of about 2 to 1 to about 1.3 to 1. In a preferred form of the invention the lower portion 30*b* of the elastic strip 30 has a width of about ½" and a stretchability of about 85% with a range of plus or minus 10% and the upper portion 30*a* has a width of about 1-½" including a 1/16" bead along the upper edge and a stretchability of about 53% with a range of plus or minus 10%. It will be noted that the elastic strip 30** is the only portion of the waistband assembly to engage the wearer's waist. This is in contrast to the elastic strip used in my prior patents where the lower portion of the elastic strip was stitched to a non-stretchable fabric curtain. As pointed out above the fabric has been eliminated in the present waistband construction.

Figure 3:
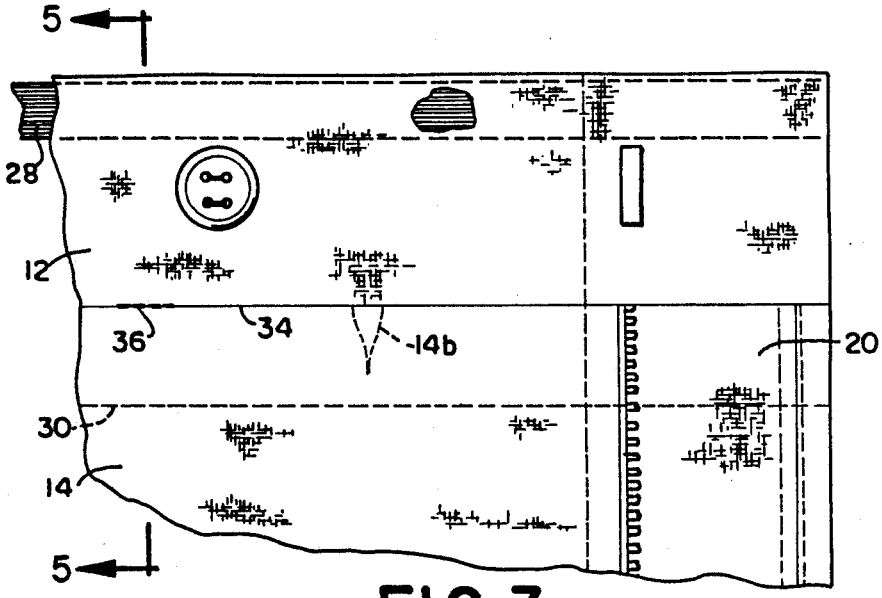
FIG. 3 is a fractional view of the so-called "white fly" portion of the trousers seen from the outside.

Referring again to FIGS. 3-5 it will be seen that the shell portion 14 of the fabric material is joined to the lower edge of the waistband 12 by the stitching 34 at a location above the lower edge of the elastic strip 30. The stitching 34 forms a seam extending around the garment and forms a juncture between the shell portion 14 of the fabric and the lower edge of the waistband portion 12. This juncture is sometimes referred to as a crack. Referring to FIG. 3 there is illustrated one of the gathers **14*b* formed in the shell 14 to provide it with fullness so that the shell 14 will have some "give", allowing it to be sewn to the stretchable waistband 12. The gathers 14*b* are further described in my aforesaid U.S. Pat. No. 4,549,317 and several gathers are incorporated in the shell material 14 around the waistband 12. In view of the substantial stretch in the elastic strip 38, I have found that that extra yield or fullness in the shell 14** can range from ⅝" to ¾" on each panel of the trousers and the waistband will stretch enough to take up this additional fullness. A pair of trousers has two panels on the front and two panels on the back and thus the total material gathered should be 1-¼" to 1-½" around each half of the waistband. It will be seen that the total amount of gathers in my new waistband construction is approximately twice that employed in my prior U.S. Pat. No. 4,549,317. This permits my new waistband construction to accommodate a larger number of sizes, i.e. up to four standard sizes.

While the upper edge or bead of the elastic strip 30 is stitched at 32 to the waistband 12 around the entire length, the elastic strip 30 is only stitched at periodic intervals around the waistband 12 to the juncture between the shell 14 and the lower edge of the waistband 12 to prevent restriction of stretch. This periodic stitching is illustrated at 36 and is referred to as a "crack" stitch.

While a preferred embodiment of the garment waistband construction has been described and illustrated, it is to be understood that further modifications thereof may be made within the scope of the appended claims.

What is claimed is:

1. A waistband assembly for a garment comprising a waistband of a fabric material turned over at its upper extremity to form a U-shaped bight with a small inner flap depending therefrom, and an elastic strip of one piece construction having an upper portion which is longitudinally elastic including means substantially preventing transverse bending of said upper portion thereby to exhibit no-roll characteristics, said upper portion being positioned adjacent to and sewn to the side of said inner flap, facing inwardly to the wearer away from said waistband at the top of said strip, said elastic strip having a lower portion extending below the lower edge of said waistband, said lower portion of said elastic strip offering a lower resistance to elongation than the upper portion of said elastic strip.

2. A waistband assembly for a garment according to claim 1 wherein said lower portion of said elastic strip has a degree of stretchability with respect to said upper portion of said elastic strip within the range of about 2 to 1 to about 1.3 to 1.

3. A waistband assembly for a garment according to claim 1 wherein said lower portion of said elastic strip has a stretchability of about 85% and said upper portion of said elastic strip has a stretchability of about 53%.

4. A waistband assembly for a garment according to claim 1 wherein the ratio of the width of the upper portion of said elastic strip to the lower portion of said elastic strip is about 3 to 1.

5. A waistband assembly for a garment according to claim 1 wherein a strip of relatively thin stretchable material is inserted in said bight of said waistband to further stiffen said waistband assembly.

6. A waistband assembly for a garment according to claim 1 wherein said fabric material comprising said waistband is cut on a bias angle of about 30° to 50°.

7. A waistband assembly for a garment according to claim 1 wherein the inner surface of said fabric material of said waistband is provided with an adhesive-fused non-woven backing material, said backing material having low stretchability in the transverse direction and high stretchability in the longitudinal direction.

8. A waistband construction for clothing comprising a shell portion and a waistband portion, wherein the exposed fabric of the shell portion and waistband portion may be of any desired fabric material, comprising:

a waistband portion of said fabric material, cut on the bias;

said waistband being turned over at its upper extremity to form a U-shaped bight portion with a small inner flap depending therefrom;

an elastic strip of one piece construction having an upper portion which is longitudinally elastic including means substantially preventing transverse bending of said upper portion thereby to exhibit no-roll characteristics, said upper portion being positioned adjacent to and sewn to the side of said inner flap, facing inwardly to the wearer away from said waistband portion at the top of said strip, said elastic strip having a lower portion extending below the lower edge of said waistband portion, said lower portion of said elastic strip offering a lower resistance to elongation than the upper portion of said elastic strip;

a shell portion of said fabric joined to the lower edge of said waistband portion at a location above the lower edge of said elastic strip;

wherein said shell portion has formed therein several gathers, said gathers being concealed away from the wearer by said elastic strip, so that said shell portion exhibits fullness, whereby a garment incorporating said waistband construction can accommodate persons of several waist sizes.

9. A waistband construction for clothing according to claim 8 wherein said bight portion has a strip of stiffening elastic material therein.

10. A waistband construction according to claim 8 wherein said elastic strip is stitched at periodic intervals around said waistband portion to the juncture between said shell portion of said fabric and the lower edge of said waistband portion to prevent restriction of stretch.

11. A waistband construction according to claim 8 wherein a fusible non-woven material is secured to the inner face of said waistband portion, said non-woven material having the characteristic of being stretchable in the longitudinal direction and substantially non-stretchable in the transverse direction.

12. A waistband construction according to claim 3 wherein said lower portion of said elastic strip has a degree of stretchability with respect to said upper portion of said elastic strip within the range of about 2 to 1 to about 1.3 to 1.

13. A waistband construction according to claim 8 wherein said lower portion of said elastic strip has a stretchability of about 85% and said upper portion of said elastic strip has a stretchability of about 53%.

14. A waistband construction according to claim 8 wherein the ratio of the width of the upper portion of said elastic strip to the lower portion of said elastic strip is about 3 to 1.

* * * * *